US006253520B1

(12) United States Patent
Houk

(10) Patent No.: US 6,253,520 B1
(45) **Date of Patent: *Jul. 3, 2001**

(54) INTERLOCKING COMPONENTS AND ASSEMBLY SYSTEM

(76) Inventor: Edward E. Houk, 6106 Townhill, San Antonio, TX (US) 78238-5033

( * ) Notice: Subject to any disclaimer, the term of this patent is extended or adjusted under 35 U.S.C. 154(b) by 0 days.

This patent is subject to a terminal disclaimer.

(21) Appl. No.: 08/553,048

(22) Filed: Nov. 3, 1995

(51) Int. Cl.[7] ..... E04B 2/46

(52) U.S. Cl. ..... 52/592.2; 52/590.2; 52/591.2; 52/637; 52/646; 52/648.1; 52/653.1

(58) Field of Search ..... 52/589.1, 590.1, 52/591.1, 591.3, 591.4, 592.2, 592.3, 79.1, 79.5, 590.2, 637, 646, 648.1, 653.1; 446/108, 109, 111, 112, 125, 116

(56) References Cited

U.S. PATENT DOCUMENTS

| | | | | |
|---|---|---|---|---|
| 2,691,242 | | 9/1954 | Young et al. . | |
| 2,882,714 | * | 4/1959 | Gagle et al. | 52/590.1 X |
| 3,264,021 | * | 8/1966 | Artman | 52/591.1 X |
| 3,591,212 | * | 7/1971 | Rhyne . | |
| 3,670,449 | * | 6/1972 | Lemign et al. . | |
| 3,924,376 | * | 12/1975 | Tsurumi | 52/591.1 |
| 3,992,834 | | 11/1976 | Valenzano . | |

OTHER PUBLICATIONS

Sweets Industrial File, structural Metals, 1996 by Dodge Corp. USA.

Sweets Architectural File, structural Metals, 1996 by Dodge Corp. USA. (2 way & 4 way trusses, short span and long span) (Also space frames –see letter).

* cited by examiner

*Primary Examiner*—Carl D. Friedman
*Assistant Examiner*—Yvonne M. Horton

(57) ABSTRACT

A structure for use in structural, load bearing construction is made from cold rolled shapes and/or shaped from structural grade sheet metals or structural shapes. The structure includes interlocking box trusses containing core members held by four web members in perpendicular alignment and pairs of parallel spaced chord members as well as facing units. Each web member and each chord member has a plurality of alternating, tapering, and projecting teeth and transverse strikes on transverse edge faces and at least one of the opposing primary faces. Each projecting tooth has a shape of a truncated pyramid with a taper on three sides of an inverted trapezoid base and with orthographic projection of a greater side, and has facets joined with at least one primary face at obtuse angles, a distance between the facets at the juncture with the primary face being less than at other respective facets. Chord members are aligned and interconnected with respective chord members of adjacent box trusses. Web members interlock with pairs of interconnected parallel spaced chord members at upper and lower transverse edge faces and with pairs of other interconnected web members of adjacent aligned box trusses at side transverse edge faces. The before mentioned facing units are deformed by wedges between the facing units and anti-compression rigid frame core members. Members are locked together in groups of three and form hollow polyhedron shaped and aligned box trusses.

2 Claims, 5 Drawing Sheets

108
106
107
115
109
105
104
102
103
101
5\27
1\2
113
110
111
3\11
112
114

201
202
203
204
205
108
102
105
109
216
102
103
101
111
103
110
206
207
104

216
103

102
102
103
102
102
206
103
214
206
213
103

207
103
103
208
209
211
111
110

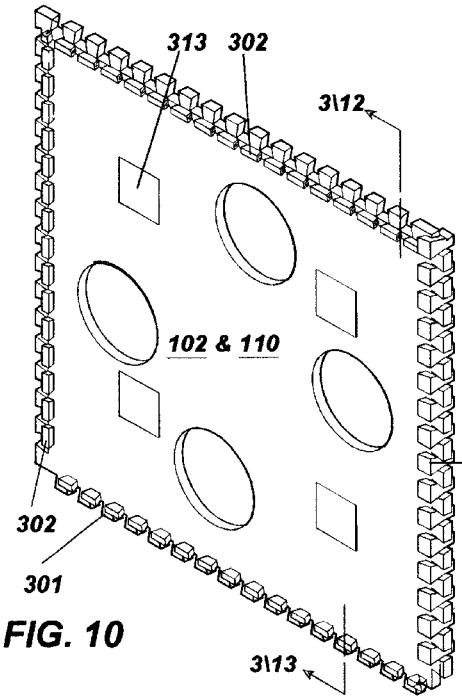
FIG. 10
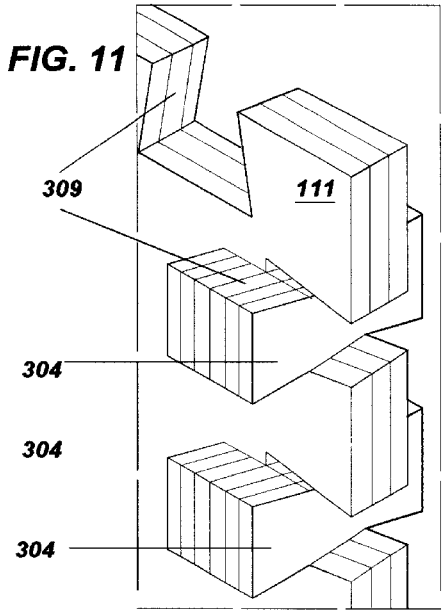
FIG. 11
FIG. 12
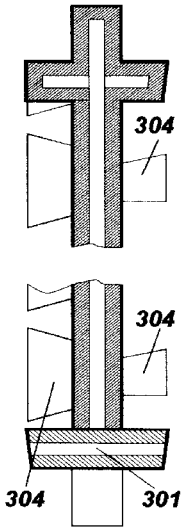
FIG. 13
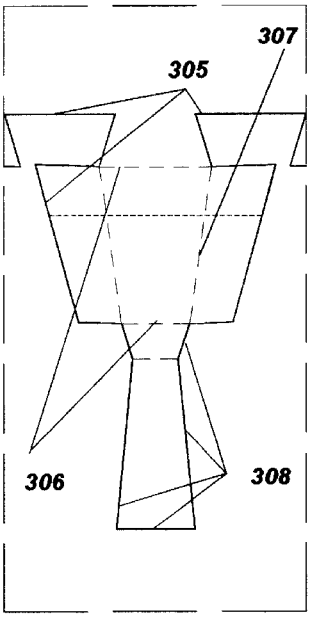
FIG. 15
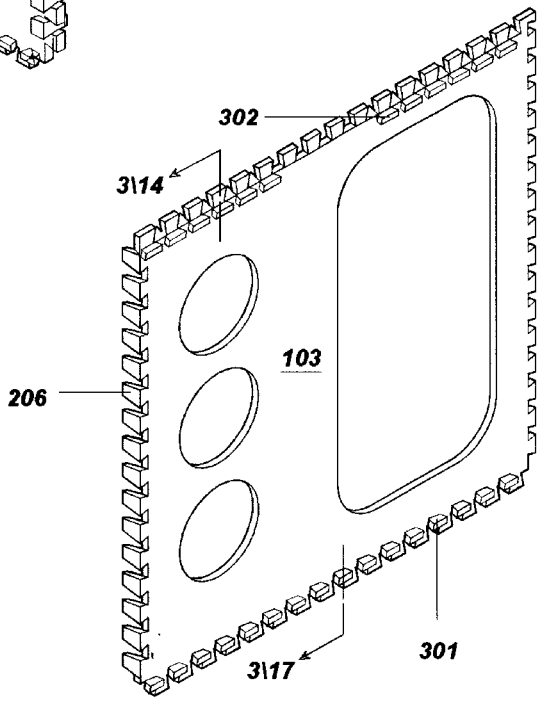
FIG. 16
FIG. 14
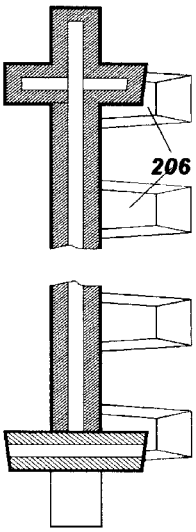
FIG. 17

404
401
4\19
101
&
111
401
413
4\24
401

401
407

407
302
102
301

206

206

206

405
406
406
406
406
406
406
406
406

103
206

102
304
302
102

501
102
301
102
103

103
102
302
304
206

504
103
102
504
506
502

104
206

103
301
104
103
102
206
206
304

102
103
301
301
103
102
206

301
309
103

304
309
110

102
&
110
309

301

INTERLOCKING COMPONENTS AND ASSEMBLY SYSTEM

This invention relates to interlocking, quick assembly, load bearing, six-way, structural steel trusses fabricated from stamped, structural grade sheet metals and structural shapes for use in construction systems; and companion application Ser. No. 08/430,806, filed Apr. 26, 1995, now U.S. Pat. No. 5,746,038 which is hereby made a part of this disclosure.

Materials used for the various components of this invention will be selected from available commercial products. Selection of specific materials will be flexible to adjust for market conditions and availability of new products.

Members of this patent are structurally specialized to react to specific positive and negative forces. They are interchangeable with members described in "CONSTRUCTION COMPONENTS and ASSEMBLY SYSTEM". Other members may be factory welded to structural beams and columns to facilitate field assembly.

This specification provides several innovative advancements to the arts related physical characteristics inherent to structural steel, protection from shear, damage from high winds and large forces, manufacture of products having undercuts on six or more polyhedron faces, assembly, and the best use of very high strength metals. It does increase, but not greatly extend or increase the ratio of truss depth to span and protection from four-hour, unsprinkled fire exposures. These advancements are:

Quick couple and assembly connections are not used in structural members except in panels and sections acting as a composite beam between two supports. Connectors are not capable of resisting bending and shear forces parallel to both primary axes of the panels. Manufactured buildings fail due to connector failures rather than failures in the metal skin or in structural support members. Specifications herein describe a four-way steel structural truss assemblage where outside forces are distributed into truss members in six directions via connectors. Connectors are protected from excessive bending, deformation, and shear. Plates penetrate intermediate walls to provide the means for direct force transference between members in six directions and to provide connectors of greater strength than primary members.

Long span structures are currently made from rigid, heavy members capable of withstanding compressive forces even though outside forces will normally result in tensile forces in those members. Structural engineers have paradigms and fears of compressive forces in thin plate or bar members in long span structures because connection of the bottom members with supporting members may induce compressive forces in members that would result in failure. This specification provides a protective device to prevent such compression, which will make the best use of high tensile strength structural steels.

Structural trusses, made of beams, bars, and angles, do not provide a ventilating system to dispel heat from fire. Steel structural systems carry higher insurance rates and may be a hazard to firemen due to failures during fires. This specification reduces the hazard by providing for convection currents to discharge the heat to the outside.

SUMMARY OF THE INVENTION

A structure is made from cold rolled shapes and/or shaped from structural grade sheet metals or structural shapes for use in structural, load bearing construction. The structure is comprised of interlocking box trusses containing core members held by web members and pairs of parallel spaced chord members as well as facing units. Each web member and each chord member has at least one major axis, upper and lower transverse edge faces, side transverse edge faces, opposing primary faces, and edges; and each web member and each chord member has a plurality of alternating, tapering, and projecting teeth and transverse strikes on transverse edge faces and at least one of the opposing primary faces. Each projecting tooth has a shape of a truncated pyramid with a taper on three sides of an inverted trapezoid base and with orthographic projection of a greater side, and has facets joined with at least one primary face at obtuse angles, a distance between the facets at the juncture with the primary face being less than at other respective facets Chord members are aligned and interconnected with respective chord members of adjacent box trusses. Web members interlock with pairs of interconnected parallel spaced chord members at upper and lower transverse edge faces and with pairs of other interconnected web members of adjacent aligned box trusses at side transverse edge faces. The before mentioned facing units are deformed by wedges between the facing units and anti-compression rigid frame core members. Members are locked together when teeth of web members interlock with teeth of two adjacent aligned chord members and with teeth of two other adjacent aligned web members, thereby forming joins of groups of three and forming hollow polyhedron shaped and aligned box trusses. And where each of the box trusses are comprised of four web members and two parallel spaced chord members, and the web members are perpendicular to each other.

BRIEF DESCRIPTION OF THE DRAWINGS

FIG. 10 shows a view of bottom and top chord tensile truss members not shown in previous illustrations.

FIG. 11 is a corner detail from FIG. 3 indicating three laminated or welded sheet metal parts forming a membrane and thru wall tensile force transference plate.

FIG. 12 is a segmented sectional view through a portion of the member shown in FIG. 10.

FIG. 13 is a second segmented sectional view through the same member.

FIG. 14 is a segmented sectional view of a portion of the member shown in FIG. 16.

FIG. 15 is a pattern diagram for forming the bolt, 206, illustrated in Sheet Two.

FIG. 16 is a view of a web member of a truss not shown in previous illustrations.

FIG. 17 is a second section of the same web member in FIG. 16.

FIG. 27 is a detail of a corner of a first web member as indicated in FIG. 3.

FIG. 28 is a view of the same corner indicated in FIG. 27 where two chord members have been connected. FIGS. 27 through 35 illustrate a partial assembly process showing the locking mechanism in detail.

FIG. 29 is a corner detail at the same location indicated in FIGS. Three, 27 and 28 illustrating a segment of a web member.

FIG. 30 is a corner detail at the same location indicated in FIGS. Three, 27 and 28 illustrating two additional chord members similar to those in FIG. 28.

FIG. 31 is a corner detail at the same location indicated in FIGS. Three, 27 and 28 illustrating the locking mechanism where the web member in FIG. 29 interlocks with two chord members in FIG. 30 the first cord member in FIG. 27.

FIG. 32 is a corner detail at the same location indicated in FIGS. Three, 27 and 28 illustrating a segmented corner of a second web member.

FIG. 33 illustrates an alternative to the locking mechanism illustrated in FIG. 31.

FIG. 34 is a corner detail at the same location indicated in FIGS. Three, 27 and 28 illustrating the assembly of members shown in FIGS. 29 and 30 with those in FIG. 31.

FIG. 35 is a corner detail at the same location indicated in FIGS. Three, 27 and 28 illustrating the assembly of member shown in FIGS. 32 and 34.

FIG. 36 is a segmented view of two bolts of a bottom chord member having a cutout for the member in following illustration.

FIG. 37 details a view of a plate member for transferring negative forces from a chord facing member to a web member.

FIG. 38 shows member in FIG. 37 installed in the opening in FIG. 36.

FIG. 39 shows member in FIG. 41 installed in the opening in FIG. 40.

FIG. 40 is a segmented view of two bolts of top and bottom chord members having a cutout for the member in the following illustration.

FIG. 41 details a view of a plate member for transferring negative forces from a chord facing member to a second web member.

FIG. 42 is a segmented view of two bolts of a web member having a cutout for the member in following illustration.

FIG. 43 details a view of a plate member for transferring negative forces from a second web member to another similar web member.

FIG. 44 shows member in FIG. 43 installed in the opening in FIG. 42.

>DETAIL DESCRIPTION OF THE DRAWINGS

Figures 18, 19, 20, 21, 22, 23, 24, 25, 26:
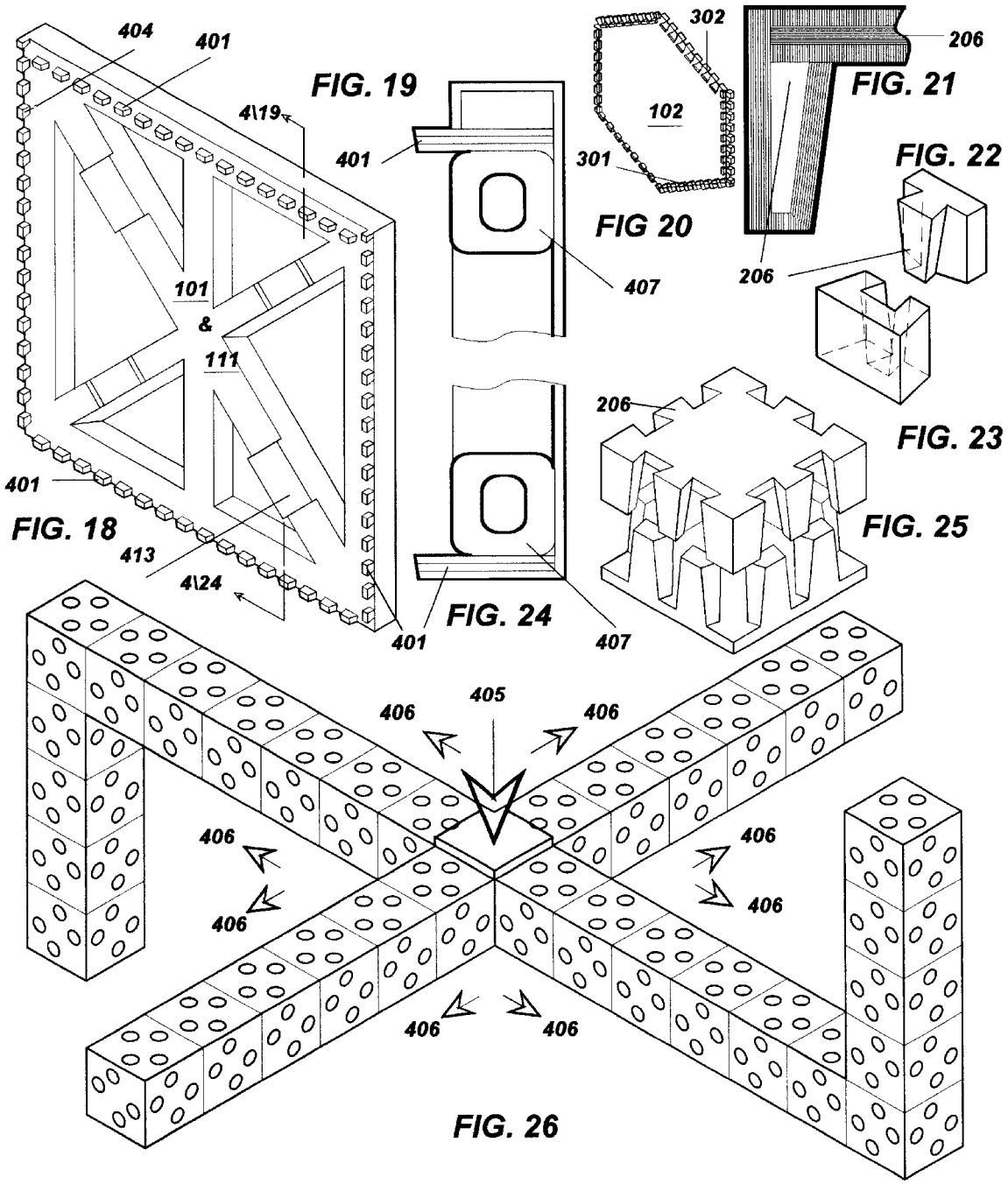
FIG. 18 is a view of a chord member of a truss not shown in previous illustrations.
FIG. 19 is a detail of a sectional segment of the chord shown in FIG. 18.
FIG. 20 illustrates an alternative shape for six sided chord member.
FIG. 21 details a segment of a section of a bolt further detailed in FIGS. Seven, Eight, and 15.
FIG. 22 is a view of companion member to FIG. 23 where the same bolt, 206, forms a quick assembly locking mechanism for structural beams.
FIG. 23 is a view of companion member to FIG. 22.
FIG. 24 is a second segment of a section of the chord shown in FIG. 18.
FIG. 25 is a view of a quick assembly member for structural columns.
FIG. 26 is a schematic exploded view of a truss assemblage.

FIGS. One, Three, and Four of the drawings provide explosive views to illustrate partial assemblages of six-way structural trusses in differing alignments. Structural trusses are assemblages common to construction of large bridge, building, marine and transportation structures. Structural trusses herein contain elements arranged in combinations of triangles and rectangles embedded within polyhedron membrane components as illustrated at 114 in FIG. 4 and encapsulated trusses at 105 and 112 in FIG. 4. When assembled, components form a rigid system resisting varying exterior forces over wide areas. Application of these outside forces will result in deformation of all members. Six-way structural truss assemblages specified herein, also referred to as trusses, have primary components, top and bottom chords with webs between the two. Chords and webs rigidly interlock to resist deformation resulting from forces defined above which quantitatively must meet and exceed applicable building and construction codes. The top chord is exposed to outside forces while the bottom chord transfers these forces into web members. Top and bottom chords are always parallel. Web components are always perpendicular to top and bottom chord components and to each other. Secondary truss members provide lateral support to prevent warp, control deformation, and protect primary components from fire and thermal damage. A top chord, a bottom chord and four web members form a cube. When an outside force is applied to the top chord the force is transferred from the cube receiving the force into four adjacent cubes and then through other cubes, each cube transferring forces into four other cubes until finally cubes transfer the force into supporting cubes which transfer forces in two other directions (totaling six). The result is a six-way truss system (four horizontals and two verticals as illustrated in FIG. 26; or it may be four verticals and two horizontals). When an exterior force is applied to a roof chord, a wall chord, a floor chord, and to a foundation chord, all members throughout the structure are deformed. The structure is much stronger than conventional post and beam systems and rigid frame systems.

The drawings illustrate thin, encapsulating shapes with proportionally very small bolts and strikes fabricated from ordinary sheet metal and high strength steel. Bolts and strikes form locks. They also transfer negative forces from one member to another. Some strikes penetrate the host member to lock with bolts of two intersecting members.

The depth of trusses will vary with the use and outside forces applied; nevertheless, for general use, trusses shall be limited in span lengths between supports to 12 times the distance between finished surfaces of top and bottom chord facings. Deformation should be checked for compliance with code specifications.

This specified directional truss is composed of the following members:

a. top chord facing unit, 101, b. top chord membrane member, 102, c. first transverse web membrane member, 103, d. second transverse web membrane member, 104, e. first encapsulated rigid frame web and compressive force transference member, 105, f. secondary encapsulated lateral reinforcing member, 106, g. secondary encapsulated lateral reinforcing member, 107, h. encapsulated insulating and secondary compression and lateral reinforcing member, 108, i. encapsulated insulating and secondary compression and lateral reinforcing member, 109, j. bottom chord membrane member, 110, k. bottom chord facing unit, 111 l. second encapsulated web and force transference member, 112 m. transition members, 201 thru 211.

All views are from the interior of the structure. Members described above are illustrated. Members, 103 and 104, are assembled in two versions. The first has ventilation openings and triangular arrangements similar to shapes 102 and 110. The second has three rectangular arrangements: two smaller arrangements, one encircling the perimeter, as well as triangular arrangements between the large opening and the three smaller openings.

Figures 1, 2, 3, 4:
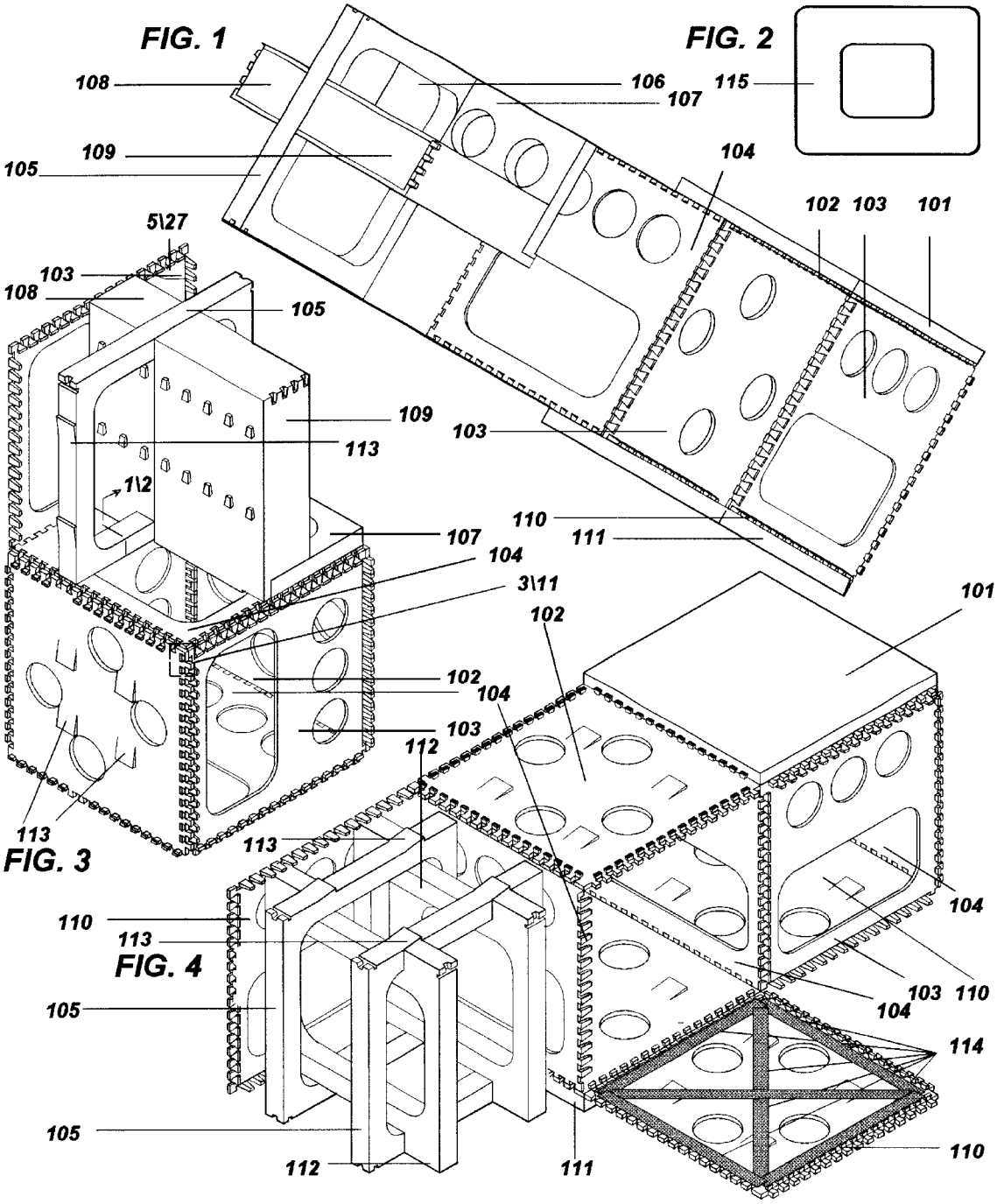
FIG. 1 illustrates the use of field shapes (not including end units or special shapes) in sloped roof systems. All three dimensional views are exploded views from the interior of the structure to show interlocking parts as well as hidden core parts.
FIG. 2 is a two-dimensional, sectional view of an encapsulated truss member.
FIG. 3 is a view of perimeter field shapes.
FIG. 4 is a view of an interior, horizontal truss assemblage.

Four web components and two chord components form a structural box truss capturing encapsulated trusses. Transverse web components 103 and 104 must always be perpendicular to chord members 102 and 110 and to each other when in a box truss. Chord components may be horizontal, vertical, or sloped; but they must always be parallel unless a triangular roof section is formed. Shapes 103 and 104 will have penetrations similar to 102 and 110 except where arranged for internal ventilation. Both ventilating configurations are illustrated in FIG. One for part 103. Larger ventilation openings illustrated for shapes 103 and 104 are stacked to form vertical chimneys and horizontal tubes to cause convection currents. These air currents protect truss assemblages, from damage from fires. Convection currents also stabilize internal temperatures to control thermal expansion. Stacked shapes 104 in FIG. 3 provide for unobstructed vertical air movement similar to house chimneys when shapes 101 and 111 are exposed to fire. Specified chimneys should extend beyond the roof a minimum of four times the width of the chimney. Fire dampers in roof penthouses and in foundation members shall be opened automatically in the event of fire, both inside and outside.

Component shapes 102, 103, 104, and 110 are tensile membrane members, whereas a device is provided to protect them from compressive loads, Membranes hold encapsulated members in the same relationship as membranes hold organs in animals. Moreover, since they are very thin in comparison to their length, they are very flexible and can readily be deformed. Edges are held securely by bolts, 206, to prevent warping and detachment. Furthermore, they are highly elastic due to characteristics of high strength materials. Wedge shaped blocks on encapsulated rigid frame web members, 105, and 112 control transfer of forces by increasing the distance between chords. Since the facing chords, 101 and 111 are of heavy tube construction (FIGS. 18, 19, 24), outward movements by the wedges force negative forces (tension) on the web members. An inward, positive, compressive force will be passed through member 105 and to 110 and 111. Adjoining members 103 and 104 will resist this deformation and will transfer this force into four other cubes until the force is dissipated in six directions. The top chord facing, 101, is subject to both positive and negative forces (resulting from wind and the before mentioned wedges). The bottom chord member, 111, is subject to negative forces caused by the wedges and to compressive forces transferred from interior floors, 105 and 112. Encapsulated members 105 and 112 are subject only to positive forces and are constructed from heavy gage tubular steel pictured at 115 in FIG. 2. Part 105 provides an advantage in that membrane members can be fabricated from high strength steels thereby making the best use for the properties of steel; it also provides a superior, lighter weight truss assemblage.

FIGS. One, Two and Four shape 102, 103, 104 and 110 are shown in groupings; while anti-compression, shear, and rotation components and members 105 through 109 and 112 are shown in other groups. Since encapsulated (core) members are always hidden inside the structural membranes, explosive views are necessary. A key member to separation of tension forces from other forces is part 105 with its wedges. It forces the top and bottom chords apart. Outside forces go through parts' 101 and 110 to part 111, forcing the top and bottom chords farther apart while protecting membrane components from compressive forces. Since components 102, 103, 104, and 110 are tension members, full advantage can be made of the high tensile properties of high strength steels.

Shapes' 101 through 112 are shown in three alignments for walls, roofs, floors and foundations. Members 102 and 110 are interchangeable, as are 101 and 111.

Shapes shown in FIG. 3 have been rotated counterclockwise to provide for a truss system for floors in FIG. Four. The core members, 105 and 112, provide for high vertical live loads such as warehousing, libraries, garages, bridges and conduits. Four force transfer wedge blocks, 113, are indicated for chord members.

FIGS. Five and Nine are shown in two groupings, perimeter shapes and foundation shapes. Special transition shapes, necessary to connect shapes shown FIG. Three with those in FIGS. One and Four, are indicated. Special shapes at openings are not illustrated. Shapes 103 and 210 have been segmented to show shapes hidden by shapes segmented. Shapes 201 and 202 are varieties of shape 102, providing for a transition to a slope, shown in the first figure. Edge modifications in 203, 204, and 209 as well as part 205 provide for changes in component alignment. Components 108 and 109 provide insulation, bracing, and secondary load support; while Components 106 and 107 resist rotation as well as shear. They all provide lateral support to primary members.

An essential part of this enhancement is the connection of exterior and interior facing units, 101 and 111 to the exterior and interior longitudinal membrane members, 102 and 110 respectively. The bottom chord facing unit, 111, is subject to differing forces, depending on its location in FIGS. One, Two, and Four. The top chord facing unit, 101, is always subject to outside forces. Longitudinal membrane members and companion facing units form respective top and bottom chords (Members' 101 and 102 form a chord; 110 and 111 form a complete bottom chord).

Figures 5, 6, 7, 8, 9:
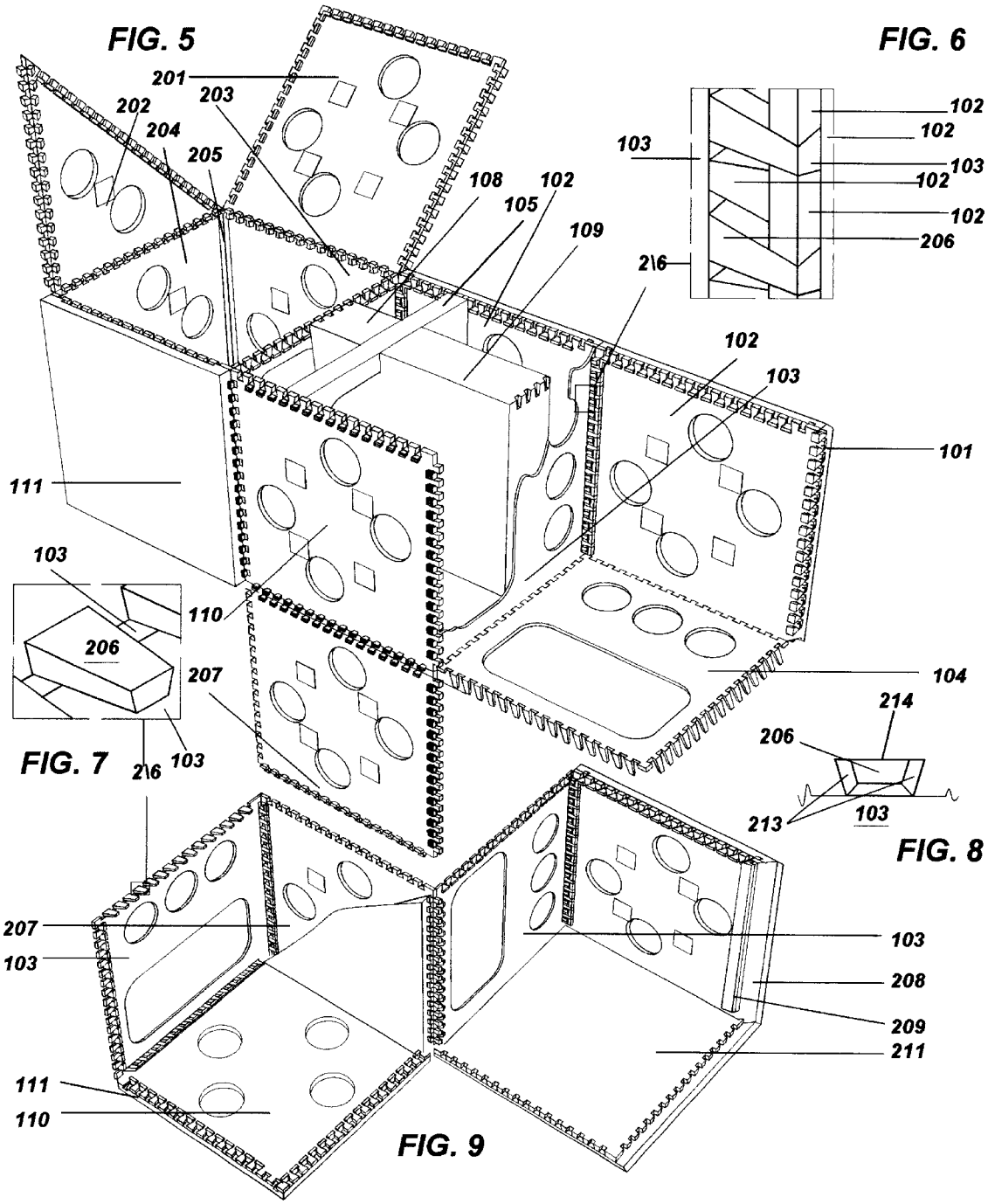
FIG. 5 is a perspective, viewed from one third of the distance of other views, of a partially assembled structure (also an exploded view) to show special shapes necessary to complete structure systems except at openings.
FIG. 6 shows a partial view of an inside corner between three locked components to illustrate dual locks or fasteners that prohibit three dimensional movements, prevent detachment of the assembly, and to stiffen edges.
FIG. 7 shows a view of a typical bolt connecting three truss components, providing dual edge stiffeners, and connecting structural cube shapes to other cube shapes.
FIG. 8 is an end view of the same locking bolt illustrated in FIG. 7 showing the taper (entering angle) on three sides of an inverted trapezoid having an orthographic projection of the greater side.
FIG. 9 illustrates the foundation portion of the assembly shown in FIG. 5.

Edge stiffeners are provided by locking bolts, 206, which lock into strikes at all edges to stiffen the joints and prevent disassembly. When locked, movement, perpendicular to the path of entry, is stopped. Dual locks (where a bolt engages two strikes) at joints between 102 and 103 are illustrated at 2\6, 5\31, and 5\35 where the first number indicates the sheet and the second indicates the figure number. Both sheet\figure and sheet/total sheets apply to the drawings; the direction of the divider and point size indicate difference in meaning. The end view of bolt 206 in FIG. 8 illustrates an inverted trapezoid; however, it may be of many shapes, provided the respective, interlocking strike fits the shape. Surface of contact with strikes is identified at 213; this is also the facet of force transference. For illustrative purposes, angles were exaggerated. To avoid the danger of shear, that cutting action of scissors, the intersecting angle between two surfaces must be less than 45° (gripping angle). A more conservative and safer intersecting angle would be half of that. However, because deflection in high strength steel and because of physical limitations during assembly (fitting force transferring plates into chord and web members), these angles must fall within a limited range. Additional angle specifications are provided hereafter.

Component 207 is a modification of shape 110 with connections for changing structural perimeter truss in FIG. Three to an interior floor and ceiling truss in FIG. Four. When shapes 101 through 112 are rotated 90° counterclockwise during assembly, their characteristics change to that of interior floor and roof trusses. An acute angle rotation in like manner will result in an alignment suited for structural roof trusses. Component 208 is also a version of component 101 while 209 is a version of 102. Modifications are indicated at the corners and at bottoms. Component 205 is a corner lock. Component 211 is a special corner foundation unit. Components 101 and 102 are companions, as are 208 and 209. Together, they form a top chord of a truss. Companions may be connected at the factory or in the field. Components 101 through 102 have been rotated 90° counterclockwise in the foundation group in FIG. 9 as well as in FIG. 4. Component 101 is a roof unit in FIG. 1, a floor unit in FIG. 4, a ground foundation unit in FIG. 9 (note: top chords are against the ground and on the bottom since outside forces originate from the ground and are directed upward), an exterior facing unit in FIG. 4. The common characteristic in all alignments of component 101 is that each is a top chord and each relays active variable live forces through component 105 to component 111. Conversely, shape 111 may be interior walls and ceilings; their commonalty being not only the attachment to shapes 110, but also the component's structural characteristic to resist compressive and tensile forces.

The backside of a chord and a web member is not seen in the first four figures; these are illustrated in FIG. 10 and FIG. 16. Primary strikes, 301, and secondary strikes, 302, are indicated in FIG. 6 and again in FIG. 10 and FIG. 16 with more detail in FIG. 41 and FIG. 43. While these transfer negative forces, positive forces are transferred by wedge blocks at 313 in FIGS. Three, Four, Five, Nine, 10 and 18. These transfer blocks must be placed on the diagonals defined by penetrations (also 114 in FIG. 4) to make best use of materials and to simplify structural analyses. Strikes 301 and 304 are detailed to show this force transference member in FIGS. 11, 36 thru 44. The force transference strike and bolt meet at a face or facet at 309. This facet must tilt in two directions to form a taper necessary for assembly and to provide a grip on the bolt that will not slip (based on principle that gripping a connection is stronger than a hook connection). The angle between this facet and aligned primary axes of members for force transference (gripping angle) of the members joined is very critical. This angle has been specified before regarding shear and deflection (or bending). Tilt angles for assembly, (entering angle of the bolt into the strike) measured from the second major axis, should be equal, or nearly equal, to the gripping angles to avoid unnecessary reduction in cross sectional area. The primary axis of primary strikes, 301, must align with the primary axis of connected webs for force transference. Connection of the two companion chord members (101 with 102 and 110 with 111) is also critical. This strike, 304 and 401, must transfer forces between web members, 103 and 104, and the rigid frame, 407, within 101 and 111. Bolts, 206, in FIGS. 7, 16, 17, 27, and 31 will engage strikes in FIGS. 10, 11, and 17 during assembly. In the fabrication of bolts, 206, membrane skins may be cut and folded to provide continuity. Cuts are indicated at 305 and 308 in FIG. 15, while 306 and 307 indicated folds. This method of manufacture is further detailed in FIG. 21. Parts 401, 404, and 413 correspond with 301, 304, and 313 respectively in that each connects with and transfers forces to its corresponding part in chord facing members, 101 and 111, shown in FIGS. 1, 4, 5, 18, 19 and 24. The structure of this chord member must be of rigid construction having a frame of structural grade tubes indicated at 407.

FIG. 20 indicates an alternative truss assemblage, the chords having eight sides in place of six. This assemblage would form truss cells resembling a honeycomb rather than a cube.

FIGS. 22, 23, and 25 illustrate a quick assembly method for installing standard steel beams and columns. The parts shown will be welded at the fabricating shop. Both parts should be placed at a distance of one-sixth of the span from a joining of beams with columns. Parts indicated in FIGS. 22 and 23 also act as expansion joints when installed at the above recommended locations. A group of "X" shaped columns and beams, with welded, x-rayed, load certified connections, can be shipped to a job site and erected without on-site welding. This system would also be applicable to Space Frames.

FIG. 26 illustrates an exploded view of a truss assemblage. A force, 205, is applied to a chord facing unit. That force is resisted by adjacent members in four directions. The resisting forces, 406, are distributed to web members represented by the arrows. Since there are two web members, 103, and two web members, 104, in each adjoining cube, the force is distributed to 16 adjoining members. Since a conventional two-way truss distributes the force into six adjoining members, the efficiency of this specified assemblage becomes apparent. Supporting truss members are represented on the left and right in FIG. 26. Fifth and sixth force directions are at these supporting members. Each of the six members forming a cube has connectors for transferring forces. In this illustration the resulting force on the supporting cubes will be the half of that of two way assemblages (supporting cubes on four vectors).

Figures 27, 28, 29, 30, 31, 32, 33, 34, 35, 36, 37, 38, 39, 40, 41, 42, 43, 44:
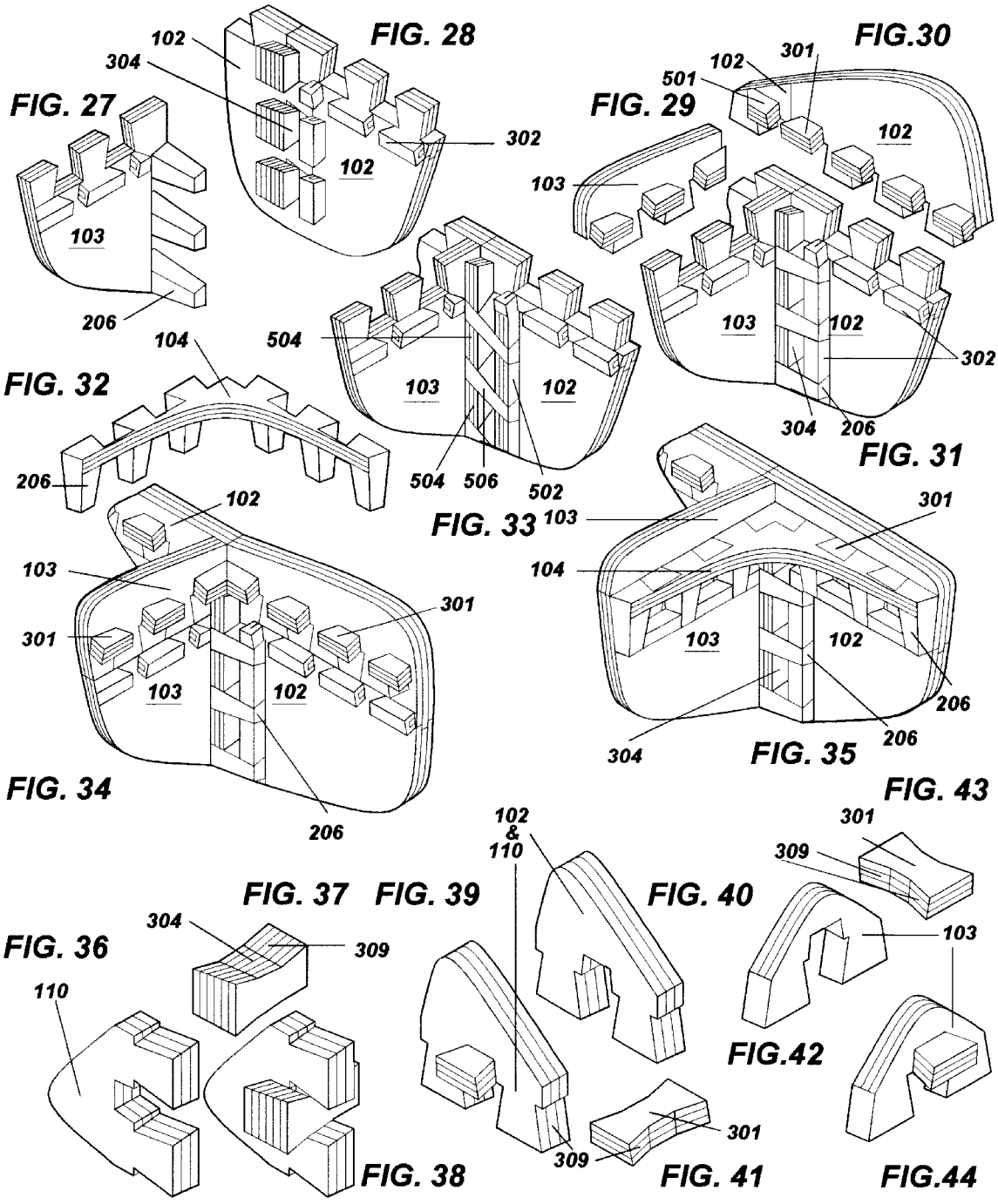

FIGS. 27 through 35 illustrate segmented details of chord and web members and assembly in the following steps:

a. Place two chord members together (FIG. 28) on each side of the previously placed members, 101 thru 112 (not shown). Then position a first web member (FIG. 27).

b. Connect the first web member to the two chord members on each side (illustrated one side in FIG. 31). Detachment of chord members is not possible when this connection is made. The corner is also stiffened by this step. Now install encapsulated members (shown in FIG. 3). Position a second web member (FIG. 29) with two additional chord members (FIG. 30) on both sides containing a corner version, 501, of plate, 301, (FIGS. 10, 41, 43).

c. Install the previously positioned second web and chord members as indicated in FIG. 34. Position another second type web member (FIG. 32). Illustrations indicate segmented members to show bolts 206 and dual strikes.

d. Assemble the positioned web member as illustrated in FIG. 35. This action prevents detachment of all previous work and stiffens the remaining edges of the cube.

An alternative bolt configuration, 506, replacing 206, is pictured in FIG. 33. This may be applicable to modification of part 103 only. Advantage is gained in the force transfer at 501. Part 504 would replace 304; however force transference would be slightly off center.

FIGS. 36 through 44 illustrate the method of fabrication of strikes that are force transmitters between two members. Extrusion or rolling of shapes having protrusions and undercuts on six faces is not possible Shapes such as 301 and 304 are difficult to roll because of the double tilt of the transfer facets. However, all parts specified herein can be cut with a rotary shear having custom blades. Strikes shown here must align with primary axes of interconnected webs; the tilt from the axis of alignment (primary membrane members, bolt, and strike) and the outward fan tilt from a second axis perpendicular to the first, shall be in a range from three to nine degrees. A lesser tilt may result in disengagement resulting from deformation; while a larger angle will pose assembly difficulties in getting a large enough section through the opening between bolts to resist forces induced by outside forces.

FIGS. 36 through 38 picture the fabrication of strikes connecting part 103 with 111 while passing through 110. Parts 101 and 111 (with strikes 401 and 404) are moved in a path toward 102 and 110 and then in a path 90° for a distance slightly greater than the depth of a strike to engage corresponding strikes 301 and 304. It is locked in position by the next chord facing. FIGS. 28 and 37 show positions of 304. FIGS. 37, 41, and 43 identify a facet of force transference at 309.

FIGS. 39 through 44 picture the fabrication of strike 301. These are further identified in FIGS. 10, 13, 17, and 34.

In summary, this document specifies six way truss assemblages superior in strength per weight of material as well as field erection time.

What is claimed is:

1. A structure for use in structural, load bearing construction, fabricated from cold rolled metallic shapes and structural grade sheet metals, comprising:

interlocking box trusses consisting of core members held by web members and pairs of parallel spaced chord members, and facing units, each of said web members and each of said chord members of said pairs of parallel spaced chord members having at least one major axis, upper and lower transverse edge faces, side transverse edge faces, opposing primary faces, and edges, each of said web members and each of said chord members of said pairs of parallel spaced chord members having a plurality of alternating, tapering, and projecting teeth and transverse strikes on said transverse edge faces and at least one of said primary faces thereof, each of said teeth having a shape of a truncated pyramid with a taper on three sides of an inverted trapezoid base with an orthographic projection of a greater side, and having facets joined with at least one primary face at obtuse angles, a distance between said facets at the juncture with said primary face being less than at other respective facets, wherein said web members are aligned perpendicular to said parallel spaced chord members;

each of said chord members of said pairs of parallel spaced chord members being aligned and interconnected with respective chord members of adjacent box trusses, said web members interlocking with pairs of interconnected parallel spaced chord members at said upper and lower transverse edge faces and with pairs of other interconnected web members of adjacent aligned box trusses at said side transverse edge faces, wherein said facing units are deformed by wedges between said facing units and anti-compression rigid frame core members; and said teeth of web members interlocking with teeth of two adjacent aligned chord members and interlocking with teeth of two other adjacent aligned web members, thereby forming joins of groups of three and forming hollow polyhedron shaped and aligned box trusses.

2. The structure according to claim 1, wherein each of said box trusses are comprised of four web members and two parallel spaced chord members, and said web members are perpendicular to each other.

* * * * *